US009083093B2

(12) United States Patent
Diessel

(10) Patent No.: US 9,083,093 B2
(45) Date of Patent: Jul. 14, 2015

(54) ELECTRICAL TERMINAL, IN PARTICULAR TERMINAL BLOCK, WITH A HOUSING AND A CONDUCTOR BAR HELD ON THE HOUSING

(75) Inventor: Thorsten Diessel, Hiddenhausen (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 128 days.

(21) Appl. No.: 13/514,107

(22) PCT Filed: Nov. 23, 2010

(86) PCT No.: PCT/EP2010/007080
§ 371 (c)(1),
(2), (4) Date: Jun. 6, 2012

(87) PCT Pub. No.: WO2011/069600
PCT Pub. Date: Jun. 16, 2011

(65) Prior Publication Data

US 2012/0244757 A1 Sep. 27, 2012

(30) Foreign Application Priority Data

Dec. 11, 2009 (DE) ..... 10 2009 057 854

(51) Int. Cl.
*H01R 9/26* (2006.01)
*H01R 4/30* (2006.01)
*H01R 13/422* (2006.01)

(52) U.S. Cl.
CPC ..... *H01R 4/302* (2013.01); *H01R 9/26* (2013.01); *H01R 9/2608* (2013.01); *H01R 13/422* (2013.01)

(58) Field of Classification Search
CPC ..... H01R 9/26; H01R 9/2608; H01R 4/302; H01R 13/422
USPC ..... 439/709, 713, 725, 718, 801, 467
See application file for complete search history.

(56) References Cited

U.S. PATENT DOCUMENTS 3,689,870 A 9/1972 Jaconette
4,767,361 A * 8/1988 Hoshino et al. ..... 439/596

(Continued)

FOREIGN PATENT DOCUMENTS

DE 900235 C 12/1953
DE 3137117 A1 4/1983

(Continued)

OTHER PUBLICATIONS

European Patent Office, International Search Report in International Patent Application No. PCT/EP2010/007080 (Mar. 17, 2011).

*Primary Examiner* — Felix O Figueroa
(74) *Attorney, Agent, or Firm* — Leydig, Voit & Mayer, Ltd.

(57) ABSTRACT

An electrical terminal includes a housing a conductor rail disposed on the housing and first and second fasteners. The first fastener includes a fastening bolt or a fastening nut and has a central axis. The first fastener includes an outer circumference corresponding to a head of the fastening bolt or to the fastening nut. The housing is configured, in a mounting position, to completely surround the outer circumference of the first fastener in a direction perpendicular to the central axis and has a shape corresponding to an outer contour of the first fastener. The second fastener includes a corresponding bolt or nut for cooperating with the first fastener. The first and second fasteners are configured to cooperate, in a position of use of the electrical terminal, so as to clamp an electrical conductor between the second fastener and the conductor rail.

9 Claims, 2 Drawing Sheets

(56) References Cited

U.S. PATENT DOCUMENTS

| | | | | |
|---|---|---|---|---|
| 5,580,286 | A * | 12/1996 | Kramer et al. | 439/801 |
| 6,234,850 | B1 | 5/2001 | Pandit et al. | |
| 6,361,382 | B1 * | 3/2002 | Yamada et al. | 439/801 |
| 6,692,314 | B1 * | 2/2004 | Pares Caselles | 439/801 |
| 2007/0049129 | A1 | 3/2007 | Pollmann | |

FOREIGN PATENT DOCUMENTS

| | | | |
|---|---|---|---|
| DE | 4237732 | A1 | 5/1994 |
| EP | 1085600 | A1 | 3/2001 |
| EP | 1758206 | A2 | 2/2007 |
| FR | 1173759 | A | 3/1959 |
| GB | 2056793 | A | 3/1981 |

* cited by examiner

ELECTRICAL TERMINAL, IN PARTICULAR TERMINAL BLOCK, WITH A HOUSING AND A CONDUCTOR BAR HELD ON THE HOUSING

CROSS REFERENCE TO RELATED APPLICATIONS

This application is a U.S. National Phase application under 35 U.S.C. §371 of International Application No. PCT/EP2010/007080, filed on Nov. 23, 2010, and claims benefit to German Patent Application No. DE 10 2009 057 854.4, filed on Dec. 11, 2009. The International Application was published in German on Jun. 16, 2011 as WO 2011/069600 A1 under PCT Article 21 (2).

FIELD

The present invention relates to an electrical terminal, in particular a terminal block, comprising a housing and a conductor rail held on the housing.

BACKGROUND

Electrical terminals are commonly known. For example, Phoenix Contact supplies a bolt connection terminal of this type with its CLIPLINE complete, RT Ring Lug Terminal terminal block system.

The known bolt connection terminal comprises a housing and a conductor rail held on the housing. The known terminal further comprises a fastening bolt or a fastening nut which cooperates with a nut or bolt corresponding thereto in the position of use of the electrical terminal in such a way that an electrical conductor to be electrically connected to the conductor rail is clamped between the nut or bolt and the conductor rail.

SUMMARY

In an embodiment, the present invention provides an electrical terminal in which the torque transmission from the fastening bolt or nut to the housing is improved.

In an embodiment, the present invention provides an electrical terminal including a housing a conductor rail disposed on the housing and first and second fasteners. The first fastener includes a fastening bolt or a fastening nut and has a central axis. The first fastener includes an outer circumference corresponding to a head of the fastening bolt or to the fastening nut. The housing is configured, in a mounting position, to completely surround the outer circumference of the first fastener in a direction perpendicular to the central axis and has a shape corresponding to an outer contour of the first fastener. The second fastener includes a corresponding bolt or nut for cooperating with the first fastener. The first and second fasteners are configured to cooperate, in a position of use of the electrical terminal, so as to clamp an electrical conductor between the second fastener and the conductor rail.

BRIEF DESCRIPTION OF THE DRAWINGS

Exemplary embodiments of the present invention are described in more detail below with reference to the schematic drawings, in which.

DETAILED DESCRIPTION

Figure 1:
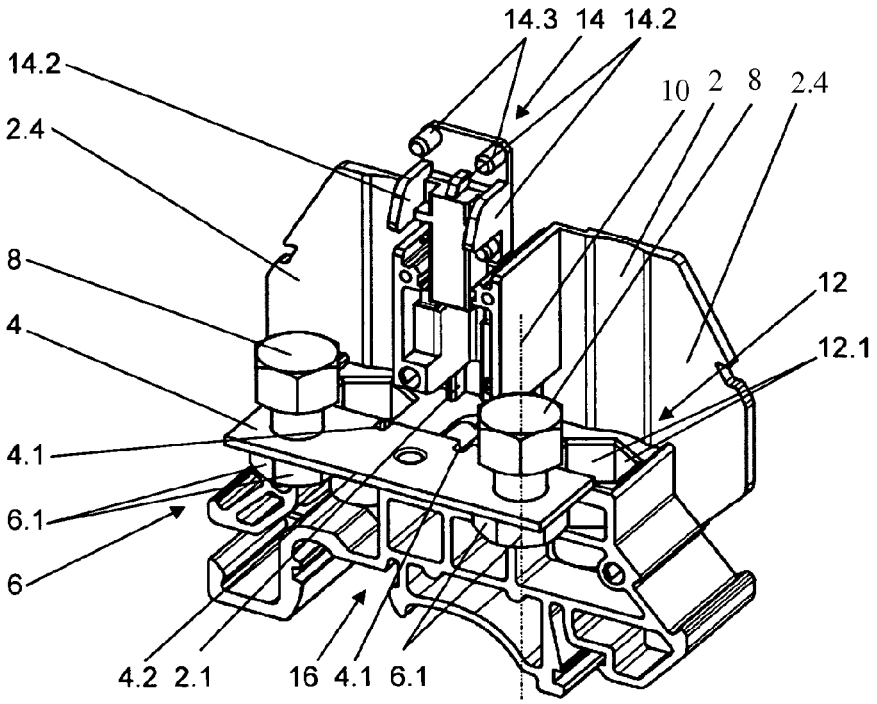
FIG. 1 is partially exploded view of a first embodiment of an electrical terminal according to the invention.

In an embodiment, the present invention provides an electrical terminal in which the torque transmission from the fastening bolt or nut to the housing is improved. Owing to the fact that, in the mounting position of the electrical terminal, the bolt head of the fastening bolt on the fastening nut thereof or the fastening nut is completely surrounded by the housing on the outer circumference thereof in a direction perpendicular to the central axis of the fastening bolt or nut, the housing being configured in the contact region so as to correspond to the outer contour of the fastening bolt or nut, the contact surface is maximised between the fastening bolt or nut and the housing in such a way that the torque passed into the electrical terminal via the fastening bolt or nut can be passed on to the housing, while simultaneously reducing the mechanical load in the individual contact surface. In this way, when electrically connecting an electrical conductor to the conductor rail of the electrical terminal, greater torques can be produced without damaging or even destroying the housing of the electrical terminal. This is of significance for bolt connection terminals since these are selected for electrical connections which depend in particular on robust electrical and mechanical contact and on being largely maintenance-free.

In principle, the electrical terminal can be freely selected according to type, material and dimensions within wide, suitable limits. This is also the case for the fastening bolts or nuts and the nut or bolt corresponding thereto. It makes sense in particular for cost-related reasons to make use of standardised bolts and nuts. It is particularly advantageous if the fastening bolt or nut and the nut or bolt corresponding thereto are formed as hexagonal bolts and nuts, since these are particularly robust and widely available.

In an embodiment, the housing comprises a securing means which fixes the conductor rail in a direction perpendicular to the central axis of the fastening bolt or nut in the mounting position of the electrical terminal. In this way, the correct position of the conductor rail is ensured in this direction in the mounting position of the electrical terminal. It is advantageous if the housing comprises a securing means which fixes the conductor rail in both directions perpendicular to the central axis of the fastening bolt or nut in the mounting position of the electrical terminal. As a result, the conductor rail is fixed in the plane perpendicular to the central axis of the fastening bolt or nut.

In an embodiment, a securing lug is arranged on the housing, the securing lug being able to be transferred from an opening position into a securing position and, in the securing position, the conductor rail being fixed between the housing and the securing lug, in a direction parallel to the central axis of the fastening bolt or nut, in the mounting position of the electrical terminal. In this way, it is possible on one hand, for simplifying the mounting of the conductor rail and thus of the electrical terminal, to provide sufficient play between the housing and the conductor rail. On the other hand, the securing lug ensures the correct position of the conductor rail in the position of use of the electrical terminal. The position of use of the electrical terminal is the position in which the electrical conductor is in an electrically conductive connection to the conductor rail of the electrical terminal, specifically is clamped between the nut or bolt and the conductor rail.

In principle, the securing lug can be freely selected according to type, material and arrangement within wide, suitable limits for this purpose. Advantageously, the securing lug can include a clamping projection, the clamping projection biasing the conductor rail against the housing in the securing position of the securing lug. The function of the securing lug is thus implemented in a constructionally simple and robust manner.

In an embodiment, the securing lug comprises a locking means which, in the securing position of the securing lug, cooperates with a lock of the housing configured to correspond thereto in such a way that the securing lug is fixed in the securing position. In this way, it is ensured that the securing lug remains in the securing position even under difficult operating conditions, such as during vibrations of the electrical terminal. In this way, the connection formed by the locking means and the lock can be configured to be releasable or non-releasable depending on the application. The person skilled in the art will select the respectively suitable method of connection, for example the locking connection, from the methods of connection known to him/her, as required.

In another embodiment having a securing lug, the securing lug is integrally formed on the housing. In this way, the production and mounting of the securing lug is simplified and the securing lug is simultaneously secured against being lost.

In an embodiment, the nut or bolt is fixed to the housing. In this way, the nut or bolt is likewise effectively secured against being lost, even if the electrical terminal has not yet been transferred into the position of use.

In principle, the electrical terminal can be configured as a single terminal. However, in many applications it is necessary to electrically interconnect a plurality of electrical terminals. In order to orientate the individual electrical terminals to one another spatially, mounting rails are conventionally used. Therefore an advantageous development provides that the electrical terminal comprises a connecting means, using which the electrical terminal can be held on a mounting rail.

In particular in the case of an electrical terminal configured as a terminal block, the housing can include an electrical insulating wall, the electrical insulating wall electrically insulating electrical terminals which adjoin one another from one another. In this way, the necessary creep resistance is produced in a constructionally particularly simple manner. This particularly applies to embodiments in which the electrical terminal has to be connected to electrical conductors which do not comprise insulated cable lugs or the like.

FIG. 1 shows an embodiment of an electrical terminal according to the invention. The electrical terminal is configured here as a terminal block. It comprises a housing 2 and a conductor rail 4 held on the housing 2, and a fastening nut 6 which, in the position of use of the electrical terminal shown in FIG. 3, cooperates with a bolt 8 corresponding thereto in such a way that an electrical conductor to be connected to the conductor rail 4 is clamped between the bolt 8 and the conductor rail 4. The fastening nut 6 is configured here as a hexagonal nut and the bolt 8 is configured here as a hexagonal bolt. The housing 2 is made from an electrical insulating material, specifically a plastics material. Suitable plastics materials are known to the person skilled in the art for this purpose. The present electrical terminal comprises two connection sides in such a way that electrical conductors can be connected to the conductor rail 4 on both sides of the electrical terminal. Since these are constructionally identically configured, the configurations on the basis of one connection side apply analogously to the other connection side. The invention is however not limited thereto. In principle it is possible that both fewer and more connection sides or connection points be provided.

Figure 2:
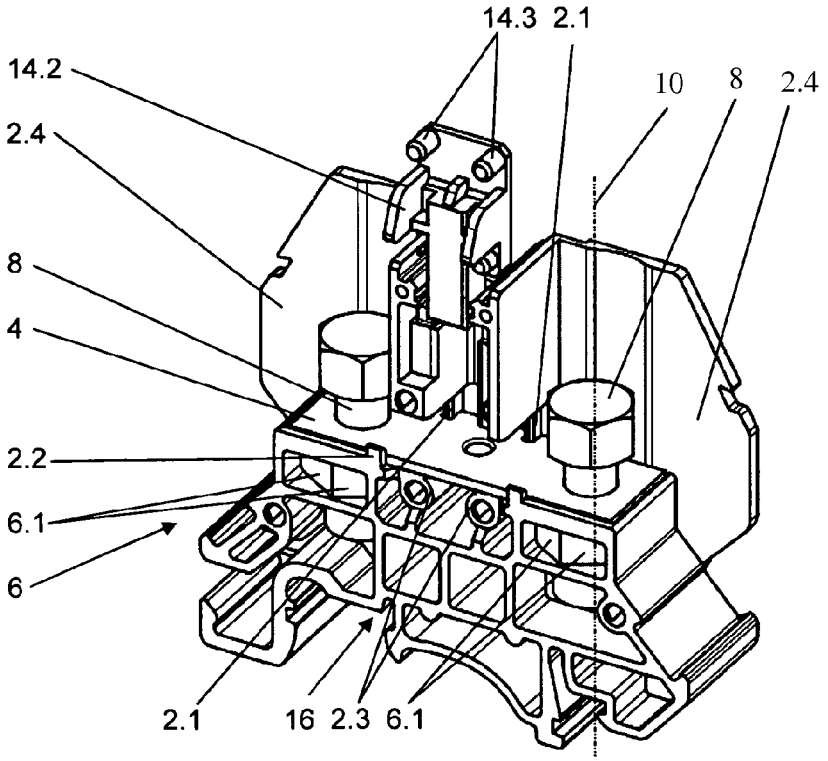
FIG. 2 is a partial view of the first embodiment in the mounting position of the electrical terminal, the securing lug being shown in the opening position.

In the mounting position of the electrical terminal shown in FIG. 2, the fastening nut 6 is completely surrounded by the housing 2 on the outer circumference thereof in a direction perpendicular to the central axis 10 of the fastening nut 6, the housing 2 being configured in the contact region so as to correspond to the outer contour of the fastening nut 6. As clearly follows from the overview of FIGS. 1 and 2, the fastening nut 6 is inserted into a recess 12, which is shaped to the outer contour of the fastening nut 6, in the housing 2 from above in the plane of the page, that is to say in a direction parallel to the central axis 10 of the fastening nut 6, during the assembly of the electrical terminal, that is to say during the transfer thereof into the mounting position shown in FIG. 2.

It can be clearly seen that the recess 12 is configured so as to correspond to the outer contour of the fastening nut 6, that is to say to the outer circumference thereof in a direction perpendicular to the central axis 10 of the fastening nut 6. The contact surfaces 6.1 of the fastening nut 6 and the contact surfaces 12.1 of the recess 12 are thus positioned side by side substantially without play, in such a way that the torque, which is passed into the electrical terminal when the electrical conductor (not shown) is fastened by the bolt 8 and thus the fastening nut 6, is passed on to the housing 2 in a desired manner. "Substantially without play" here means that only enough play is provided for the fastening nut 6 to be able to be inserted into the recess 12 without difficulty when the electrical terminal is transferred into the mounting position. For this purpose, the use of tools is possibly also necessary, depending on the desired application, in order to be able to produce, for example, a tighter fit of the fastening nut 6 in the recess 12.

The housing 2 in this case comprises a first securing means 2.1 and a second securing means 2.2 which each fix the conductor rail 4 in a direction perpendicular to the central axis 10 of the fastening nut 6 in the mounting position of the electrical terminal.

The first securing means 2.1 is configured as two housing projections and, in the mounting position of the electrical terminal, engages with two grooves 4.1 in the conductor rail 4 corresponding thereto. In this way, the conductor rail 4 is fixed in the longitudinal direction of the conductor rail 4 in the mounting position of the electrical terminal.

The second securing means 2.2 is configured as two housing elevations and, in the mounting position of the electrical terminal, engages with the longitudinal edge 4.2 of the conductor rail 4. In this way, the conductor rail 4 is fixed in the transverse direction of the conductor rail 4 in the mounting position of the electrical terminal.

In order to simplify the assembly of the electrical terminal, that is to say the transfer thereof from the position shown in FIG. 1 into the mounting position shown in FIG. 2, the bolt 8 is already screwed into the fastening nut 6 in such a way that handling is made easier for the mounting staff, a robot or the like. Due to the necessary mounting direction of the mounting group, formed from the conductor rail 4, the two fastening nuts 6 and the bolts 8 corresponding thereto, specifically parallel to the central axis 10, sufficient spacing has to be available in the region of the conductor rail 4 in the housing 2, as can be seen from the overview in FIGS. 1 and 2.

So that the spacing in the mounting position of the electrical terminal, see FIG. 2, does not lead to the conductor rail 4 being able to disengage from the correct position in an undesired manner, for example during vibrations or the like, a securing lug 14 is provided here. The securing lug 14 can be arranged on the housing 2 in any suitable manner which is known to the person skilled in the art. In the case of the present embodiment, the securing lug 14 is integrally formed on the housing 2, that is to say it is an integral component of the housing 2.

Figure 3:
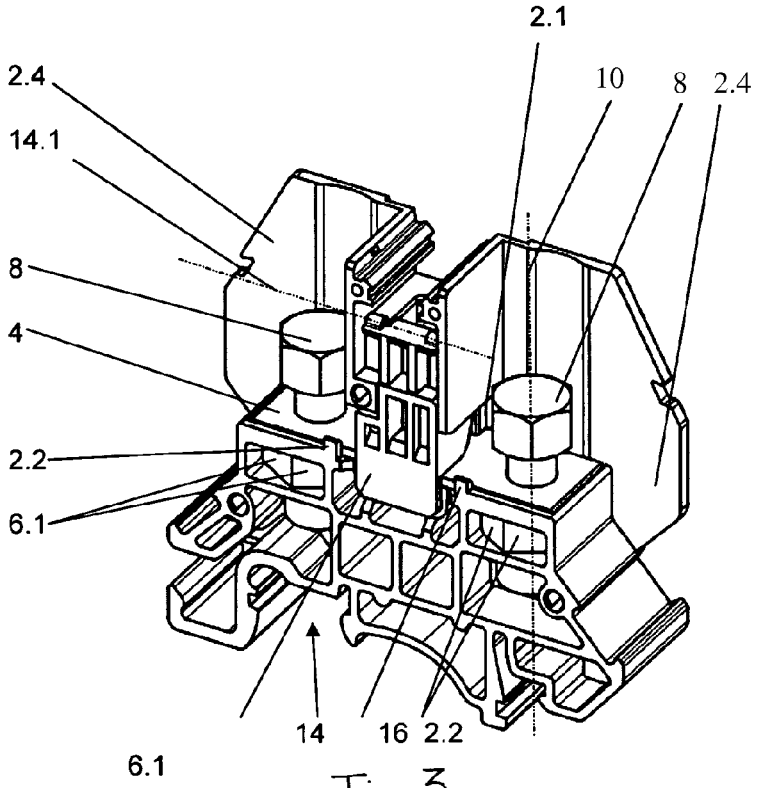
FIG. 3 is a partial view of the first embodiment in the position of use of the electrical terminal, the securing lug being shown in the securing position.

The securing lug 14 can be transferred from an opening position shown in FIGS. 1 and 2 into a securing position shown in FIG. 3. To do this, the securing lug 14 is pivoted about a pivot axis 14.1. In the securing position, the conductor rail 4 is fixed between the housing 2 and the securing lug 14, in a direction parallel to the central axis 10 of the fastening nut 6, in the mounting position of the electrical terminal. For this purpose, the securing lug 14 comprises three clamping projections 14.2, the clamping projections 14.2 biasing the conductor rail 4 against the housing 2 in the securing position of the securing lug 14. As can be seen from FIGS. 1 and 2, the clamping projections 14.2 are configured so as to be ramp-like, in such a way that transferring the securing lug 14 from the opening position into the securing position is made possible with a smaller exertion of force.

Furthermore, the securing lug 14 additionally comprises a locking means 14.3, which, in the securing position of the securing lug 14, cooperates with a lock 2.3 of the housing 2 configured to correspond thereto in such a way that the securing lug 14 is fixed in the securing position. In the present embodiment, the locking means 14.3 is configured as two locking clamps and the lock is configured as two lock striker plates, the locking means 14.3 and the lock 2.3 producing a releasable locking connection in the securing position of the securing lug 14. In principle, however, other releasable and non-releasable methods of connection are also conceivable which are known to the person skilled in the art and can be selected depending on the application.

As already mentioned at the outset, the electrical terminal of the first embodiment is configured as a terminal block. Terminals of this type are conventionally fastened to mounting rails in such a way that the electrical terminal of this embodiment additionally comprises a connecting means 16, using which the electrical terminal can be held on a mounting rail (not shown). The connecting means 16 is configured here as an outer contour of the underside of the housing 2, specifically as a longitudinal profile, the connecting means 16 being able to be brought into engagement with the mounting rail for fastening to said mounting rail with a positive fit in a manner known to the person skilled in the art.

So that the terminal block according to the present embodiment is also suitable for electrical conductors whose cable lugs or the like are not insulated, the housing 2 comprises an electrical insulating wall 2.4, the electrical insulating wall 2.4 electrically insulating electrical terminals which adjoin one another from one another. Since two connection sides are available in the present embodiment, two insulating walls 2.4 are also correspondingly provided.

Figure 4:
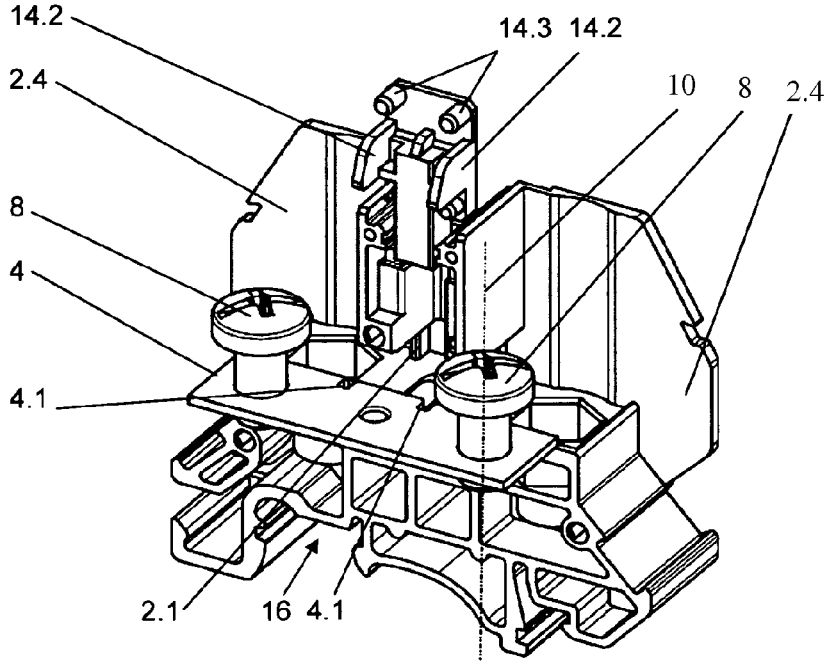
FIG. 4 is a partially exploded view, analogous to FIG. 1, of a second embodiment of an electrical terminal according to the invention.

Another embodiment of an electrical terminal according to the invention is shown in FIG. 4. In contrast to the embodiment of FIGS. 1-3, the bolt 8 is not configured here as a hexagonal bolt, but as a cross-head bolt. Besides this, the second embodiment corresponds to the first in such a way that reference can be made to the above configurations. Identical or corresponding components are denoted by identical reference numerals. In contrast to the embodiment shown in FIGS. 1 to 3, the fastening nuts are not shown here.

However, the invention not limited to the described embodiments. For example, instead of a fastening nut 6 and bolt 8 corresponding thereto, a fastening bolt and a nut corresponding thereto can also be used. The person skilled in the art will, depending on the application, make the corresponding selection. Furthermore, it is conceivable, in contrast to the described embodiments, that the bolt 8 or the nut is fixed to the housing.

List Of Reference Numerals

2 housing
2.1 first securing means
2.2 second securing means
2.3 lock
2.4 electrical insulating wall
4 conductor rail
4.1 groove in the conductor rail
4.2 longitudinal edge of the conductor rail
6 fastening nut
6.1 contact surface of the fastening nut
8 bolt
10 central axis of the fastening nut
12 recess
12.1 contact surface of the recess
14 securing lug
14.1 pivot axis
14.2 clamping projection
14.3 locking means
16 connecting means

The invention claimed is:

1. An electrical terminal comprising:

a housing;

a conductor rail disposed on the housing;

a first fastener including a fastening bolt or a fastening nut and having a central axis, the first fastener including an outer circumference corresponding to a head of the fastening bolt or to the fastening nut, the housing being configured, in a mounting position, to completely surround the outer circumference of the first fastener in a direction perpendicular to the central axis and having a shape corresponding to an outer contour of the first fastener;

a second fastener including a corresponding bolt or nut for cooperating with the first fastener, the first and second fasteners being configured to cooperate, in a position of use of the electrical terminal, so as to clamp an electrical conductor between the second fastener and the conductor rail; and a securing lug disposed on the housing, the securing lug having an opening position and a securing position and being configured, when in the securing position, to fix the conductor rail between the securing lug and the housing in a direction parallel to the central axis of the first fastener in the mounting position of the electrical terminal;

wherein the securing lug includes a clamping projection having a ramp-like shape that biases the conductor rail against the housing when in the securing position.

2. The electrical terminal recited in claim 1, wherein the electrical terminal is a terminal block.

3. The electrical terminal recited in claim 1, wherein each of the first fastener and second fastener are one of a hexagonal bolt and a hexagonal nut.

4. The electrical terminal recited in claim 1, wherein the housing includes a securing device configured to fix the conductor rail in the direction perpendicular to the central axis of the first fastener in the mounting position of the electrical terminal.

5. The electrical terminal recited in claim 1, wherein the securing lug includes a locking device configured to cooperate with a lock of the housing when the securing lug is in the securing position so as to lock the securing lug in the securing position.

6. The electrical terminal recited in claim 1, wherein the securing lug is integrally formed with the housing.

7. The electrical terminal recited in claim 1, wherein the second fastener is fixed to the housing.

8. The electrical terminal recited in claim 1, further comprising a connector for holding the electrical terminal on a mounting rail.

9. The electrical terminal recited in claim 1, wherein the electrical terminal is a terminal block, and wherein the housing includes an electrical insulating wall configured to electrically insulate the electrical terminal from an adjoining electrical terminal.

* * * * *